US010697218B2

(12) United States Patent
Frielingsdorf

(10) Patent No.: US 10,697,218 B2
(45) Date of Patent: Jun. 30, 2020

(54) HINGE BAND FOR A PARTITION ELEMENT

(71) Applicant: KL Megla GmbH, Eitorf (DE)

(72) Inventor: Martin Frielingsdorf, Werkhausen (DE)

(73) Assignee: KL MEGLA GMBH, Eitorf (DE)

( * ) Notice: Subject to any disclaimer, the term of this patent is extended or adjusted under 35 U.S.C. 154(b) by 0 days.

(21) Appl. No.: 16/039,028

(22) Filed: Jul. 18, 2018

(65) Prior Publication Data

US 2019/0032382 A1 Jan. 31, 2019

(30) Foreign Application Priority Data

Jul. 25, 2017 (DE) ..... 10 2017 212 714

(51) Int. Cl.

| | |
|---|---|
| ***E05D 7/06*** | (2006.01) |
| ***E05D 7/00*** | (2006.01) |
| ***E05D 5/02*** | (2006.01) |
| ***E05D 7/081*** | (2006.01) |
| ***E05F 1/06*** | (2006.01) |
| ***E05D 3/02*** | (2006.01) |
| ***E06B 3/50*** | (2006.01) |

(52) U.S. Cl.

CPC ..... *E05D 7/00* (2013.01); *E05D 3/02* (2013.01); *E05D 5/0246* (2013.01); *E05D 7/081* (2013.01); *E05F 1/063* (2013.01); *E06B 3/50* (2013.01); *E05Y 2201/638* (2013.01); *E05Y 2600/56* (2013.01); *E05Y 2800/672* (2013.01)

(58) Field of Classification Search

CPC ... E05D 7/00; E05D 7/081; E06B 3/48; E06B 3/50; E06B 3/02; E05F 1/063; E05Y 2201/638

USPC ..... 49/236, 237, 239

See application file for complete search history.

(56) References Cited

U.S. PATENT DOCUMENTS

| | | | | |
|---|---|---|---|---|
| 1,116,851 A | | 11/1914 | Schneible | |
| 3,378,881 A | * | 4/1968 | Hentzi | E05F 1/063 16/312 |
| 3,398,487 A | * | 8/1968 | Matyas | E05F 1/063 16/312 |
| 3,510,986 A | * | 5/1970 | Berkowitz | E05F 1/1215 16/256 |
| 3,546,736 A | * | 12/1970 | Booth | E05F 1/063 16/312 |

(Continued)

FOREIGN PATENT DOCUMENTS

| | | |
|---|---|---|
| CN | 202347974 U | 7/2012 |
| CN | 203034976 U | 7/2013 |

(Continued)

*Primary Examiner* — Jerry E Redman

(74) *Attorney, Agent, or Firm* — Hodgson Russ LLP

(57) ABSTRACT

A hinge band for a partition element, particularly for a door or for a window, and a partition installation having such a hinge band are disclosed. The hinge band has a first band part and a second band part, wherein the first band part is connected to the second band part for hinge action about a hinge axle pin in such a manner that the first band part is rotatable relative to the second band part about a rotation axis. Furthermore, a lifting or lowering installation is provided, wherein on account of the lifting or lowering installation the first band part in a movement of the first band part relative to the second band part about the rotation axis is moved along the rotation axis.

33 Claims, 4 Drawing Sheets

(56) References Cited

U.S. PATENT DOCUMENTS 3,722,031 A * 3/1973 Bourgeois ..... E05F 1/063 16/317
4,078,334 A * 3/1978 Lambias ..... E05F 1/065 49/237
4,090,274 A * 5/1978 Bourgeois ..... E05F 1/063 16/317
4,124,955 A * 11/1978 Kochis ..... E05F 1/065 160/354
4,215,449 A * 8/1980 Loikitz ..... E05F 1/063 16/303
4,631,777 A * 12/1986 Takimoto ..... E05F 1/063 16/312
4,697,306 A * 10/1987 Rhodes ..... E05F 1/063 16/317
5,045,636 A * 9/1991 Johnasen ..... C07K 14/811 174/375
5,369,842 A * 12/1994 Beatty ..... E05F 1/063 16/317
5,500,984 A * 3/1996 Lee ..... E05F 1/063 16/309
5,613,276 A * 3/1997 Franz ..... A47K 3/36 16/229
6,161,255 A 12/2000 Garrett
7,013,531 B2 * 3/2006 Jackson ..... E05F 1/063 16/309
8,166,612 B2 * 5/2012 Bertolini ..... E05D 7/0027 16/244
8,510,913 B2 * 8/2013 Kim ..... E05D 11/06 16/268
8,613,161 B2 * 12/2013 Nicholson ..... A47F 3/0434 312/116
8,701,248 B2 * 4/2014 Dries ..... E05D 5/10 16/280
8,745,922 B1 * 6/2014 Matsuda ..... A01K 1/0017 49/236
8,776,436 B2 * 7/2014 Miller ..... E05F 1/043 49/236
8,782,953 B2 * 7/2014 Bongiovanni ..... E05F 1/1223 16/309
8,813,313 B2 * 8/2014 Freitas Marinho ..... E05F 1/14 16/378
10,165,870 B2 * 1/2019 Artwohl ..... A47F 3/0434
2002/0116788 A1 * 8/2002 Pompei ..... E05F 1/063 16/315
2004/0244293 A1 * 12/2004 Eckel ..... E05F 1/063 49/334
2005/0246863 A1 * 11/2005 Chesworth ..... E05F 1/063 16/221
2007/0169413 A1 * 7/2007 Miller ..... E05F 1/065 49/236
2007/0193118 A1 * 8/2007 Miller ..... E05F 1/043 49/236
2008/0276424 A1 * 11/2008 Gunderson ..... E05F 1/061 16/286
2017/0167173 A1 * 6/2017 Johnson ..... E05D 11/0081
2017/0226787 A1 * 8/2017 Sprague ..... E05F 1/06

FOREIGN PATENT DOCUMENTS

DE 20210845 U1 9/2002
DE 202010008660 U1 12/2010
EP 0599255 A1 6/1994
WO 2017093956 A1 6/2017

* cited by examiner

HINGE BAND FOR A PARTITION ELEMENT

The invention relates to a hinge band for a partition element, particularly for a door or for a window. The hinge band is provided, for example, for a glass door. The invention furthermore relates to a partition installation having a hinge band of this type.

A hinge band for doors or windows which has a first band part and a second band part which are interconnected for hinge action about a hinge axle pin is known from the prior art. A rotation axis runs along the hinge axle pin. The first band part is configured having a receptacle installation in the form of a clamping installation having clamping plates for a door or a window. A latching installation which has a latching member, the latter being guided so as to be movable counter to the action of a spring, and a latching clearance is disposed on the known hinge band. The latching clearance is attached to the circumference of a rotary member which is mounted so as to be rotatable about the hinge axle pin. The latching member in the latched position engages in the latching clearance. The latched position defines a preferred position of the first band part relative to the second band part, for example an opening position or a closing position.

A hinge band in which the rotation axis runs in a plane of a door leaf is also known from the prior art. This known hinge band is disposed on an upper edge or on a lower edge of a door. The known hinge band has a first band part and a second band part which are interconnected for hinge action about a hinge axle pin. The first band part can be rotated relative to the second band part about a rotation axis. The first band part is configured having a receptacle installation for receiving a door leaf. The rotation axis of the hinge band is aligned in such a manner that the rotation axis runs in the plane of the door leaf. Furthermore, a latching installation by way of which preferred positions of the first band part in respect of the second band part are predefined is provided in the case of the known hinge band. The latching installation comprises a latching member and a latching clearance, wherein the latching clearance is disposed on the hinge axle pin.

In terms of the prior art, reference is made to EP 0 599 255 B1 and to U.S. Pat. No. 6,161,255 A1.

A hinge band for doors or windows, particularly for glass swing doors, is furthermore known from DE 202 10 845 U1. The known hinge band has a first band part and a second band part which are interconnected for hinge action about a rotation axis. Furthermore, a lifting/lowering device which is disposed on the first band part and on the second band part is provided, wherein on account of the lifting/lowering device the second band part in a movement of the first band part relative to the second band part about the rotation axis is moved along the rotation axis. The known hinge band is therefore a lifting/lowering hinge band.

It is now increasingly required and desired that glass panes, particularly glass doors, are moved, the weight of said panes or doors being more than 120 kg. Moving, particularly moving by way of a pivot action, a glass pane having a weight of this type is possible only with difficulty by way of the lifting/lowering hinge bands known today. The lifting/lowering hinge bands known today can typically support and move only doors having a weight in the range of a maximum of 40 kg to 60 kg.

In order for a heavyweight of a glass pane to be held and moved by way of a lifting/lowering hinge band, a very stable hinge band is required. If a hinge band based on the technology known today is used, said hinge band would have to be configured so as to be rather large in order for the weight to be sufficiently absorbed in well by the hinge band. However, a very large hinge band is typically undesirable. Said hinge band is typically insufficiently esthetic.

The invention is therefore based on the object of specifying a lifting/lowering hinge band which can move a door of at least 120 kg.

According to the invention, this object is achieved by a hinge band having the features of claim 1. A partition installation having a hinge band of this type is provided by the features of claim 17. Further features of the invention are derived from the following description, the following claims, and/or the appended figures.

The hinge band according to the invention is provided for a partition element. The partition element is configured, for example, as a door or as a window. The door is configured as a swing door, for example. It is provided particularly that the partition element is configured as a glass door, for example as a glass swing door. The hinge band according to the invention has at least one first band part and at least one second band part, wherein the first band part is connected to the second band part for hinge action about a hinge axle pin in such a manner that the first band part is rotatable relative to the second band part about a rotation axis. The hinge axle pin is, for example, a metal pin, particularly a cylindrical metal pin. The hinge band according to the invention has a lifting/lowering installation which is disposed on the first band part and on the second band part. On account of the lifting/lowering installation the first band part in a movement of the first band part relative to the second band part about the rotation axis is moved along the rotation axis and, in particular, moved away from the second band part.

At least one receptacle installation for disposing the partition element is disposed on the hinge band according to the invention. The receptacle installation is configured as a clamping installation, for example. It is provided particularly that the receptacle installation of the hinge band according to the invention has a first clamping unit and a second clamping unit for disposing the partition element in a clamped manner between the first clamping unit and the second clamping unit.

The lifting/lowering installation of the hinge band according to the invention has a first hinge axle unit which is disposed on the first band part and which has a first opening, wherein the hinge axle pin is disposed in the first opening. The lifting/lowering installation of the hinge band according to the invention furthermore has a second hinge axle unit which is disposed on the second band part and which has a second opening, wherein the hinge axle pin is disposed in the second opening.

The first hinge axle unit of the hinge band according to the invention has a first running face, wherein the first running face is configured so as to be concave. In other words, the first running face is curved in an inward manner. The second hinge axle unit of the hinge band according to the invention furthermore has a second running face, wherein the second running face is configured so as to be convex. In other words, the second running face is curved in an outward manner. The first running face is disposed on the second running face. Furthermore, the first running face is configured so as to be movable relative to the second running face.

The hinge band according to the invention has the advantage that by virtue of the particular configuration of the first running face and of the second running face, large faces which are disposed on one another and are, for example, in contact with one another are created. By virtue of the large face it is possible for a heavy weight, particularly a weight of at least 120 kg, of the partition element to be absorbed.

In the case of one embodiment of the hinge band according to the invention it is additionally or alternatively provided that the first running face in a plan view is configured as a first divided circular ring. The first divided circular ring has a first divided circle and a second divided circle. The first divided circle of the first divided circular ring from a first center has a first radius $R_{11}$. For example, the first center is disposed on the rotation axis. The second divided circle of the first divided circular ring from the first center has a second radius $R_{12}$. The first radius $R_{11}$ of the first divided circle of the first divided circular ring is larger than the second radius $R_{12}$ of the second divided circle of the first divided circular ring. A first divided circular line of the first divided circular ring is disposed between the first divided circle of the first divided circular ring and the second divided circle of the second divided circular ring. The first divided circular line of the first divided circular ring from the first center has a third radius $R_{13}$, wherein the third radius $R_{13}$ of the first divided circular line is defined by $$R_{13}=R_{12}+(R_{11}-R_{12})/2).$$

The first running face, in a side view which is perpendicular to the plan view, along the first divided circular line has first vertexes which are configured as minima of the first running face and from which first side walls of the first running face extend downward. The first running face is accordingly configured so as to be concave. In other words, each sectional view of the first running face in a plane in which the rotation axis runs has a vertex which is configured as the minimum of the first running face and from which side walls of the first running face extend downward. The minimum is therefore part of the first running face. Yet again in other words, the first side walls extend along the rotation axis counter to the movement direction of the first band part. In other words, each sectional view of the first running face in a plane in which the rotation axis runs has a vertex which is configured as the minimum of the first running face and from which side walls of the first running face extend downward.

In the case of a further embodiment of the hinge band according to the invention it is additionally or alternatively provided that the second running face in a plan view is configured as a second divided circular ring. The second divided circular ring has a first divided circle and a second divided circle. The first divided circle of the second divided circular ring from a second center has a first radius $R_{21}$. For example, the second center is disposed on the rotation axis. The second divided circle of the second divided circular ring from the second center has a second radius $R_{22}$. The first radius $R_{21}$ of the first divided circle of the second divided circular ring is larger than the second radius $R_{22}$ of the second divided circle of the second divided circular ring. A second divided circular line of the second divided circular ring is disposed between the first divided circle of the second divided circular ring and the second divided circle of the second divided circular ring. The second divided circular line of the second divided circular ring from the second center has a third radius $R_{23}$, wherein the third radius $R_{23}$ of the second divided circular line is defined by $$R_{23}=R_{22}+((R_{21}-R_{22})/2).$$

The second running face, in a side view which is perpendicular to the plan view, along the second divided circular line has second vertexes which are configured as maxima of the second running face and from which second side walls of the second running face extend downward. The second running face is accordingly configured so as to be convex. In other words, the second side walls extend along the rotation axis counter to the movement direction of the first band part. In yet again other words, each sectional view of the second running face in a plane in which the rotation axis runs has a vertex which is configured as the maximum of the second running face and from which side walls of the second running face extend downward. The maximum is part of the second running face.

In the case of a further embodiment of the hinge band according to the invention it is additionally or alternatively provided that the first running face in a side view, for example in a sectional view, is configured as a first running face circular arc, wherein the first running face circular arc, proceeding from a first circular arc center, has a first circular arc radius. Additionally or alternatively thereto, it is provided that the second running face in a side view, for example in a sectional view, is configured as a second running face circular arc, wherein the second running face circular arc, proceeding from a second circular arc center, has a second circular arc radius. It is provided particularly that the first circular arc radius and the second circular arc radius are identical.

In the case of yet another further embodiment of the hinge band according to the invention it is additionally or alternatively provided that the first running face has at least one first run-up portion, at least one first gradient portion, and at least one first run-off portion. The first gradient portion is disposed between the first run-up portion and the first run-off portion and has a gradient. The first run-up portion and the first run-off portion are disposed so as to be mutually spaced apart along the rotation axis. Additionally or alternatively thereto it is provided that the first run-up portion, the first gradient portion, and the first run-off portion are disposed across 180° along a first circular arcuate distance. It is particularly provided herein that the first run-up portion is disposed across 40° along the first circular arcuate distance, and that the first gradient portion, having a gradient of 10 mm and a gradient angle of 34°, is disposed across 80° along the first circular arcuate distance. It is furthermore additionally or alternatively provided that the first run-off portion is disposed across 60° along the first circular arcuate distance.

In the case of an embodiment of the hinge band according to the invention it is additionally or alternatively provided that the second running face has at least one second run-up portion, at least one second gradient portion, and at least one second run-off portion. The second gradient portion is disposed between the second run-up portion and the second run-off portion and has a gradient. The second run-up portion and the second run-off portion are disposed so as to be mutually spaced apart along the rotation axis. Additionally or alternatively hereto it is provided that the second run-up portion, the second gradient portion, and the second run-off portion are disposed across 180° along a second circular arcuate distance. It is particularly provided herein that the second run-up portion is disposed across 40° along the second circular arcuate distance, and that the second gradient portion, having a gradient of 10 mm and a gradient angle of 34°, is disposed across 80° along the second circular arcuate distance. It is furthermore additionally or alternatively provided that the second run-off portion is disposed across 60° along the second circular arcuate distance.

In the case of a further embodiment of the hinge band according to the invention it is additionally or alternatively provided that the second hinge axle unit has a clamping installation for releasably disposing the second hinge axle unit on the hinge axle pin. For example, the second hinge axle unit is configured so as to be slotted. The second hinge axle unit particularly has a first slot unit and a second slot unit, the latter two being separated by a slot. Screw elements engage from the first slot unit in threads of the second slot unit. The second hinge axle unit can thus be fastened to the hinge axle pin. It is particularly possible for a "zero position", thus a specific relative position of the first band part in relation to the second band part, to be set. The specific relative position is, for example, a closing position of the partition element.

As has already been mentioned above, in the case of a further embodiment of the hinge band according to the invention it is additionally or alternatively provided that the receptacle installation is disposed on the first band part, and that the receptacle installation has a first clamping unit and a second clamping unit for disposing the partition element in a clamped manner between the first clamping unit and the second clamping unit.

As has likewise already been mentioned above, in the case of an embodiment of the hinge band according to the invention it is additionally or alternatively provided that the hinge band is configured for a door or a window.

In the case of yet another further embodiment of the hinge band according to the invention it is additionally or alternatively provided that the first running face is configured so as to be partially or completely concave. In the case of an embodiment of the hinge band according to the invention it is additionally or alternatively provided that the second running face is configured so as to be partially or completely convex. In the case of a further embodiment of the hinge band according to the invention it is additionally or alternatively provided that the first opening of the first hinge axle unit is configured as a passage opening. In the case of yet another further embodiment of the hinge band according to the invention it is additionally or alternatively provided that the second opening of the second hinge axle unit is configured as a passage opening. In the case of yet another further embodiment of the hinge band according to the invention it is additionally or alternatively provided that the first opening is disposed so as to be centric on the first hinge axle unit. In the case of an embodiment of the hinge band according to the invention it is additionally or alternatively provided that the second opening is disposed so as to be centric on the second hinge axle unit.

In the case of a further embodiment of the hinge band according to the invention it is additionally or alternatively provided that a latching installation is disposed on the first hinge axle unit and on the second hinge axle unit. For example, the first hinge axle unit has a first latching clearance on the first run-off face. Furthermore, the second hinge axle unit has a first latching cam on the second run-off face, for example, said latching cam being able to engage in the latching clearance of the first hinge axle unit.

The invention also relates to a partition installation having at least one partition element, for example a door, particularly glass door, or a window, for example. The partition installation according to the invention moreover has at least one hinge band which has at least one of the features mentioned hereinabove or hereinbelow, or a combination of at least two of the features mentioned hereinabove or hereinbelow.

Further practical embodiments and advantages of the invention are described hereinbelow in conjunction with the drawings in which.

Figure 1:
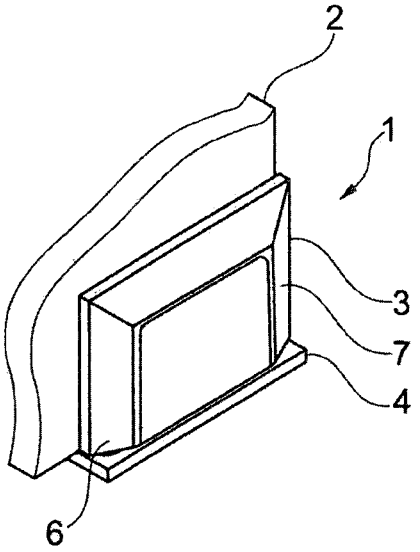
FIG. 1 shows a schematic illustration of a hinge band for a partition element, in a first position.
Figure 2:
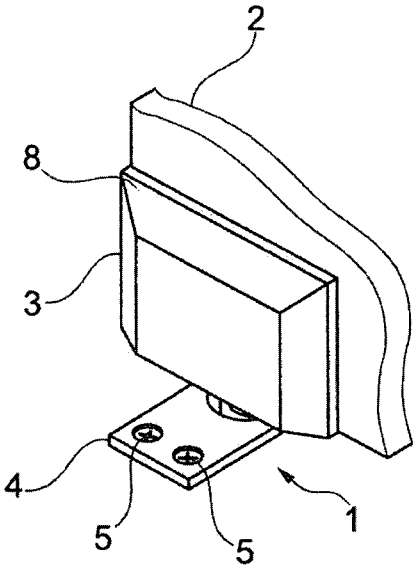
FIG. 2 shows a schematic illustration of the hinge band according to FIG. 1, in a second position.
Figure 3:
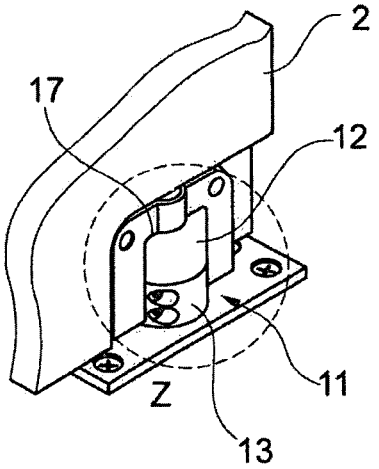
FIG. 3 shows a schematic illustration of the hinge band according to FIG. 1, having a clamping unit removed.
Figure 4:
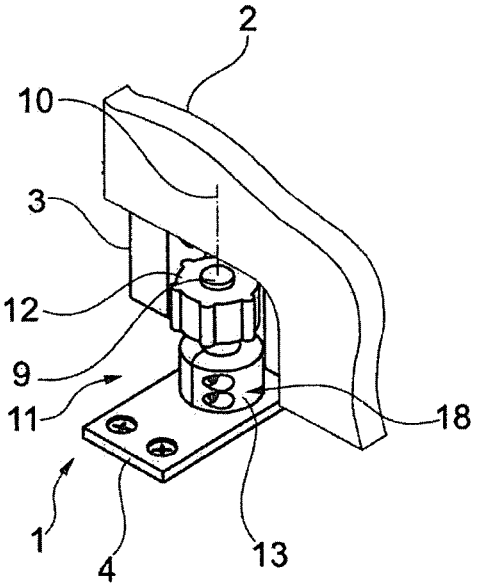
FIG. 4 shows a schematic illustration of the hinge band according to FIG. 2, having a clamping unit removed.
Figure 5:
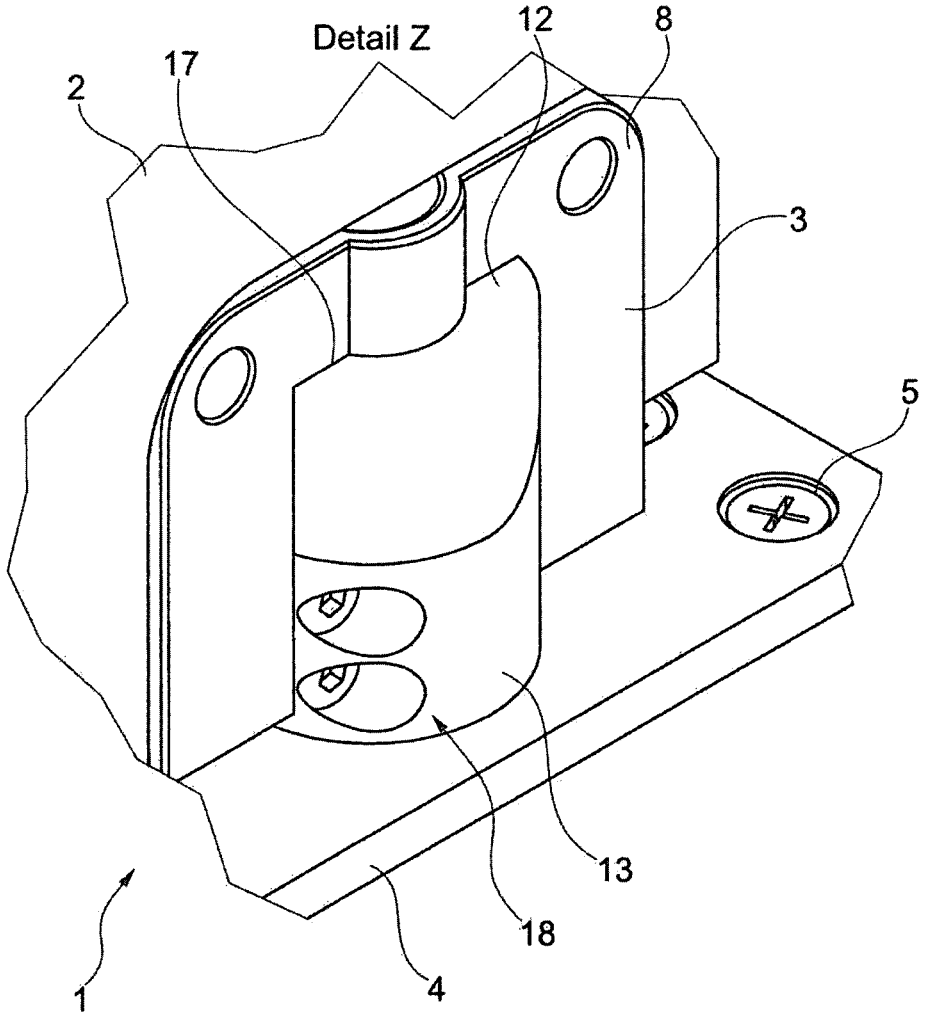
FIG. 5 shows a detailed view the region Z according to FIG. 3.

FIGS. 1 to 5 will be discussed initially hereinbelow. FIG. 1 shows a schematic illustration of a hinge band 1 for a partition element 2 in a first position. FIG. 2 shows the hinge band 2 according to FIG. 1 in a second position. FIG. 3 shows the hinge band according to FIG. 1 in the first position, having a clamping unit removed. By contrast, FIG. 4 shows the hinge band 1 according to FIG. 2 in the second position, having the clamping unit removed. FIG. 5 shows a detailed view of the region Z according to FIG. 3. The same reference signs at all times indicate the same components.

The first position is, for example, a closing position of the petition element 2. The partition element 2 is, for example, a door, particularly a glass door or a glass swing door. In the case of the exemplary embodiment illustrated in FIGS. 1 to 5 the partition element 2 is configured as a pane of a glass door. The second position of the partition element 2 is an open position of the hinge band 1. The second position in relation to the first position is disposed in such a manner that the partition element 2 in the open position (cf. FIG. 2) is disposed so as to be pivoted by 90° in relation to the first position (cf. FIG. 1).

The hinge band 1 has a first band part 3 and a second band part 4. The first band part 3 is provided with the receptacle installation 6. The receptacle installation 6 has a first clamping unit 7 and a second clamping unit 8 for disposing the partition element 2 in a clamping manner between the first clamping unit 7 and the second clamping unit 8. The second band part 4 is configured so as to be plate-shaped and by way of fastening means 5 can be disposed on a floor of a room, for example. For example, screws are suitable as fastening means 5.

The first band part 3 is connected to the second band part 4 for hinge action about a hinge axle pin 9 in such a manner that the first band part 3 is rotatable relative to the second band part 4 about a rotation axis 10. The hinge axle pin 9 is, for example, a metal pin, particularly a cylindrical metal pin.

A cylinder axis of the metal pin in this instance corresponds to the rotation axis 10. The invention is not limited to a metal pin. Rather, any pin which is suitable for the invention can be used as the hinge axle pin.

The hinge band 1 furthermore has a lifting/lowering installation 11 which is disposed on the first band part 3 as well as on the second band part 4. On account of the lifting/lowering installation 11 the first band part 3 in a movement of the first band part 3 relative to the second band part 4 about the rotation axis 10 is moved along the rotation axis 10. For example, this movement has been performed in a movement of the first band part 3 from the closed position (cf. FIGS. 1 and 3) relative to the second band part 4 to the open position (cf. FIGS. 2 and 4). It is particularly provided that in a movement of the first band part 3 from the first position to the second position, the first band part 3 rotates about the rotation axis 10, on the one hand, and moves away from the second band part 4 in the direction of the rotation axis 10, on the other hand.

The lifting/lowering installation 11 has a first hinge axle unit 12 and a second hinge axle unit 13. The first hinge axle unit 12 is disposed on the first band part 3. It is particularly provided that guiding protrusions 15 which engage in guiding receptacles 16 which are disposed on the first clamping unit 7 of the receptacle installation 6 (cf. FIG. 6) are configured on an external face 14 of the first hinge axle unit 12. In this way, the first hinge axle unit 12 is securely held on the first band part 3. One end of the first hinge axle unit 12 bears on a support face 17 of the receptacle installation 6. The support face 17 can be configured, for example, on the first clamping unit 7 and/or on the second clamping unit 8. In a movement of the first band part 3 relative to the second band part 4, the first hinge axle unit 12 raises the first band part 3 in relation to the second band part 4. The movement of the first band part 3 relative to the second band part 4 along the rotation axis 10 occurs. This will be explained in yet more detail further below.

The hinge axle pin 9 is fixedly disposed on the second band part 4. The second hinge axle unit 13 is disposed on the hinge axle pin 9 by means of a clamping installation 18. The second hinge axle unit 12 is thus disposed on the second band part 4. This will be discussed in yet more detail further below. As will likewise be described in yet more detail below, the first hinge axle unit 12 has a first opening, wherein the hinge axle pin 9 is disposed in the first opening. Furthermore, the second hinge axle unit 13 has a second opening, wherein the hinge axle pin 9 is disposed in the second opening. This will also be discussed in yet more detail further below.

Figure 8:
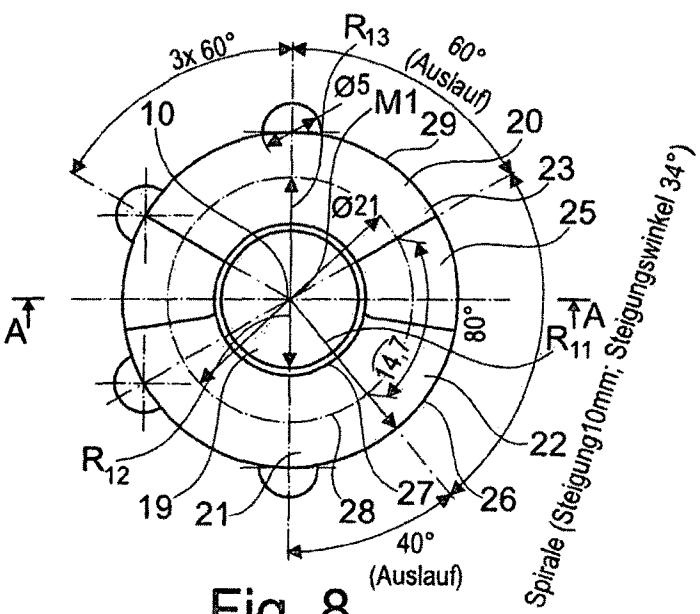
FIG. 8 shows a plan view of the first hinge axle unit according to FIG. 7.
Figure 7:
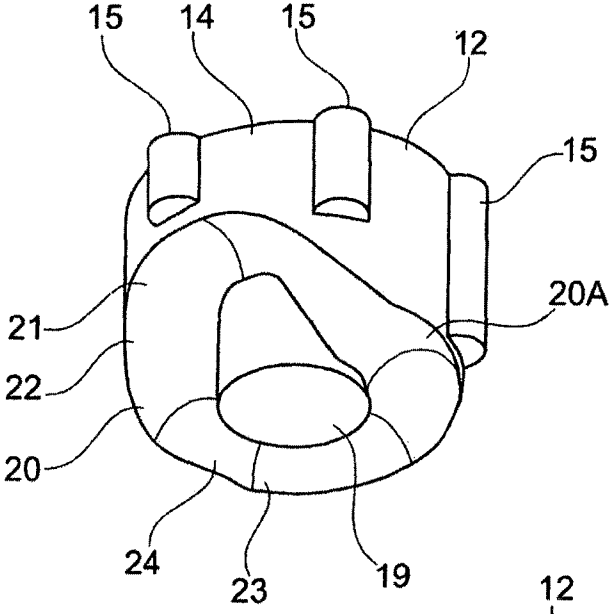
FIG. 7 shows a schematic illustration of the first hinge axle unit.
Figure 10:
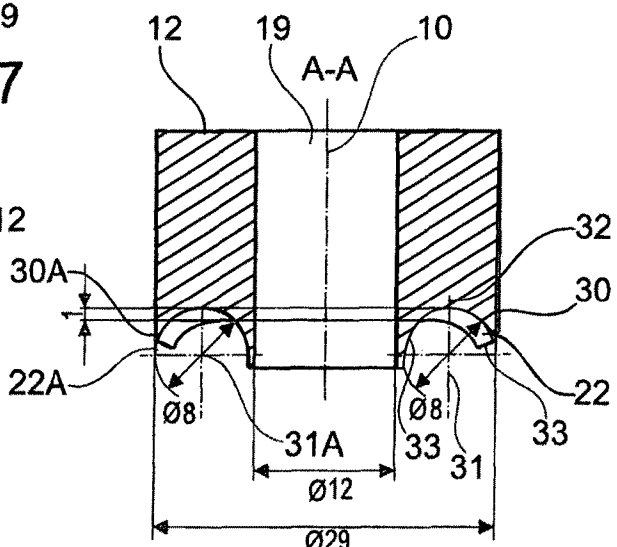
FIG. 10 shows a sectional view of the first hinge axle unit along the line A-A according to FIG. 8.
Figure 9:
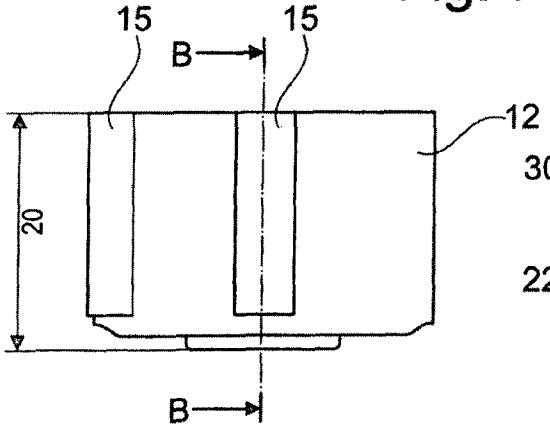
FIG. 9 shows a side view of the first hinge axle unit, the latter as compared to the illustration in FIG. 8 being tilted out of the image plane by 90°.

FIGS. 7 to 11 will be discussed hereinbelow. FIG. 7 shows a schematic illustration of the first hinge axle unit 12. FIG. 8 shows a plan view of the first hinge axle unit 12 according to FIG. 7. FIG. 9 shows a side view of the first hinge axle unit 12 which as compared to the illustration in FIG. 8 has been tilted out of the image plane by 90°. Furthermore, FIG. 10 shows a sectional view of the first hinge axle unit 12 along the line A-A according to FIG. 8.

Figure 11:
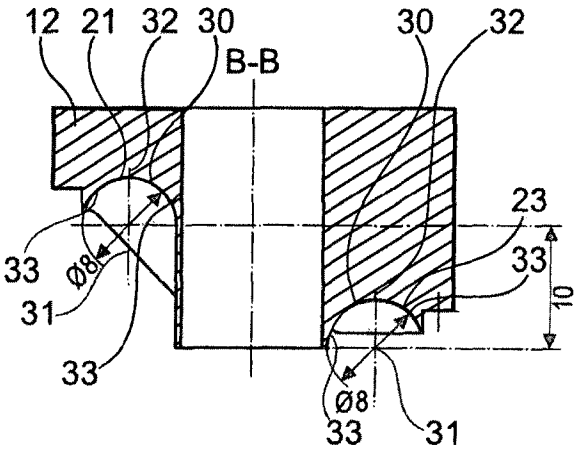
FIG. 11 shows a sectional view of the first hinge axle unit along the line B-B according to FIG. 9.

Moreover, FIG. 11 shows a sectional view of the first hinge axle unit 12 along the line B-B according to FIG. 9. The same reference signs denote in each case the same components.

Figure 6:
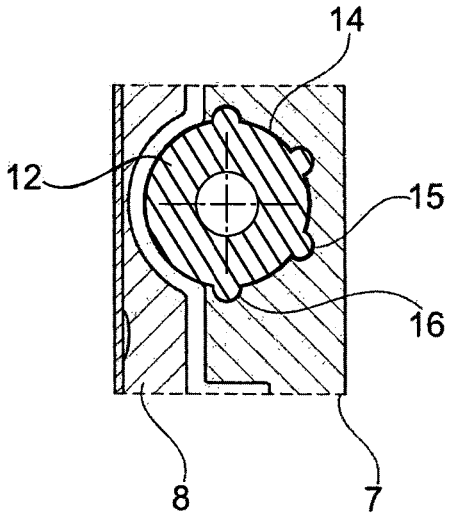
FIG. 6 shows a first hinge axle unit that is disposed in a first band part of the hinge band according to FIGS. 1 and 2.

As has already been mentioned above, the guiding protrusions 15 which are disposed in the guiding receptacles 16 of the first clamping unit 7 are disposed on the external face 14 (cf. particularly FIGS. 6, 7, and 9).

As is shown particularly in FIG. 7, the first hinge axle unit 12 centrically has a first opening 19 in which the hinge axle pin 9 is disposed. The first hinge axle unit 12 is mounted so as to be rotatable about the hinge axle pin 9. The first hinge axle unit 12 furthermore has a first running face 20. The first running face 20 has a plurality of portions, specifically a first run-up portion 21, a first gradient portion 22, and a first run-off portion 23. The first gradient portion 22 is disposed between the first run-up portion 21 and the first run-off portion 23 and has a gradient. This will be discussed in yet more detail further below. The external diameter of the first hinge axle unit 12 is, for example, 29 mm, and the height of the first hinge axle unit 12 (measured along the rotation axis 10) is, for example, 20 mm. the diameter of the first opening 19 is, for example, 12 mm.

As is shown particularly in FIG. 8, the first running face 20 extends across 180° across a first divided circular ring 25 in the form of a half ring. The first divided circular ring has a first divided circle 26 in the form of a semicircle, and a second divided circle in the form of a semicircle. The first divided circle 26 of the first divided circular ring 25 from a first center M1 has a first radius $R_{11}$. The first center M1 lies on the rotation axis 10 which runs perpendicularly into the image plane and is disposed so as to be centric in the first opening 19. The second divided circle 27 of the first divided circular ring 25 from the first center M1 has a second radius $R_{12}$. The first radius $R_{11}$ of the first divided circle 26 of the first divided circular ring 25 is larger than the second radius $R_{12}$ of the second divided circle 27 of the first divided circular ring 25. A first divided circular line 28 of the first divided circular ring 25 is disposed between the first divided circle 26 of the first divided circular ring 25 and the second divided circle 27 of the first divided circular ring 25. The first divided circular line 28 of the first divided circular ring 25 from the first center M1 has a third radius $R_{13}$. The third radius $R_{13}$ of the first divided circular line 28 is defined by $$R_{13}=R_{12}+((R_{11}-R_{12})/2).$$

As has already been mentioned above, the first running face 20 extends across 180° across the first divided circular ring 25 in the form of a half ring. The first running face 20 thus also extends across 180° across a first circular arc 29. The first run-up portion 21, the first gradient portion 22, and the first run-off portion 23 are disposed across 180° along the first circular arc 29. For example, the first run-up portion 21 herein runs across 40° along the first circular arc 29. For example, the first gradient portion 22 furthermore runs across 80° along the first circular arc 29. For example, the first run-off portion 23 furthermore runs across 60° along the first circular arc 29. The invention is not limited to the aforementioned angular distances. Rather, any angular distances which are suitable for the invention can be used for the invention.

As has already been mentioned above, the first gradient portion 22 runs across 80° along the first circular arc 29, for example. This is performed, for example, by way of a gradient of 10 mm and of a gradient angle of 34°. For example, the first gradient portion 22 is routed in a helical manner. The invention is not limited to the aforementioned gradient and the aforementioned gradient angle. Rather, any gradients and gradient angles which are suitable for the invention can be used for the invention. For example, the gradient can be in the range from 5 mm to 20 mm, wherein the range limits are included herein. Furthermore, the gradient angle can be in the range from 25° to 45°, wherein the range limits are included herein.

As can be seen particularly from FIG. 7, the first hinge axle unit 12 can have a further first running face 20A which is configured so as to be mirror-symmetrical to the first running face 20, wherein the rotation axis 10 lies in a symmetry plane, said symmetry plane in FIG. 10 running perpendicularly into the image plane.

FIG. 10 shows particularly the first gradient portion and a further first gradient portion 22A of the further first running face 20A. The first running face 22 in a side view is configured as a first running face circular arc 30, wherein the first running face circular arc 30, proceeding from a first circular arc center 31, has a first circular arc radius. The first circular arc radius in the case of the exemplary embodiment illustrated here is, for example, 4 mm. The same applies in analogous manner to the further first gradient portion 22A. The latter in a side view is also configured as a further first running face circular arc 30A, wherein the further first running face circular arc 30A, proceeding from a further first circular arc center 31A, has a further first circular arc radius. The further first circular arc radius in the case of the exemplary embodiment illustrated here is, for example, 4 mm.

The entire first running face 20, or at least a substantial part of the first running face 20, is configured like the first gradient portion 22. Particularly, the first run-up portion 21 and the first run-off portion 23 are likewise configured like the first gradient portion 22 and thus have the first running face circular arc 30, wherein the first running face circular arc 30, proceeding from the first circular arc center 31, has the first circular arc radius. The same applies in analogous manner to the further first running face 20A.

As can be seen particularly from FIG. 11, the first run-up portion 21 and the first run-off portion 23 are disposed so as to be spaced apart along the rotation axis 10. As has been explained above, the first gradient portion 22 which provides the gradient from the first run-up portion 21 to the first run-off portion 23 is disposed between the first run-up portion 21 and the first run-off portion 23.

As is shown particularly in FIGS. 10 and 11, the entire first running face 20, in a side view which is perpendicular to the plan view according to FIG. 8, along the first divided circular line 30 of the first divided circular ring 25 has first vertexes 32 which are configured as minima of the first running face 20, and from which first side walls 33 extend downward. In other words, the first side walls 33 extend counter to the movement direction of the first band part 3. In yet again other words, the first running face 20 is configured so as to be completely or substantially concave.

Figure 13:
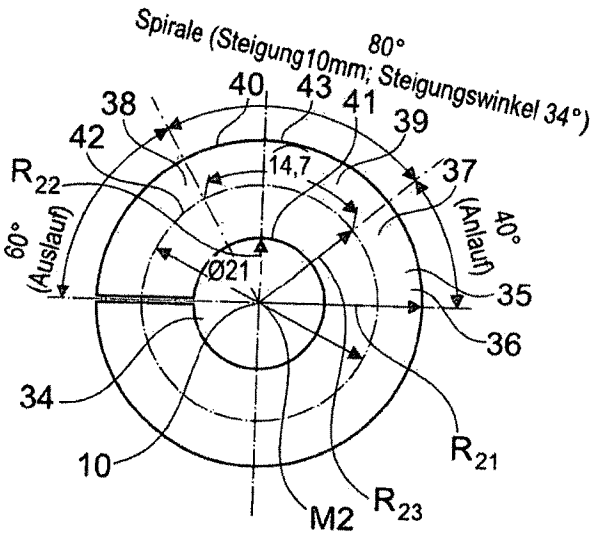
FIG. 13 shows a plan view of the second hinge axle unit according to FIG. 12.
Figure 16:
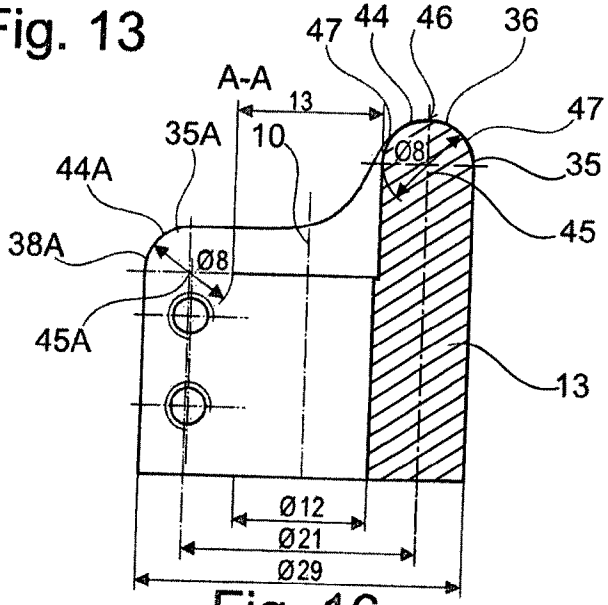
FIG. 16 shows a partial sectional view of the second hinge axle unit along the line A-A according to FIG. 15.
Figure 12:
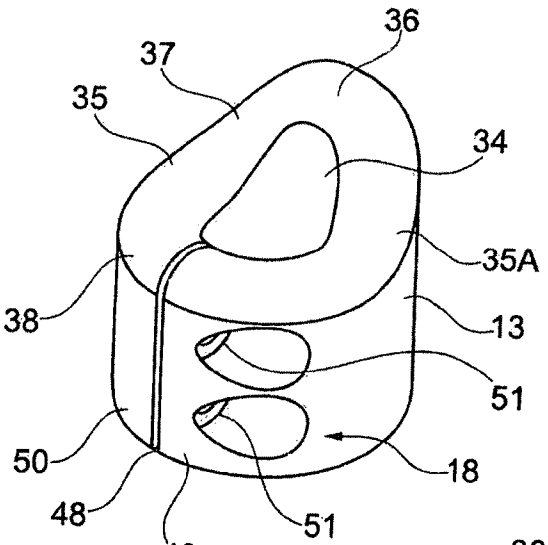
FIG. 12 shows a schematic illustration of the second hinge axle unit.
Figure 15:
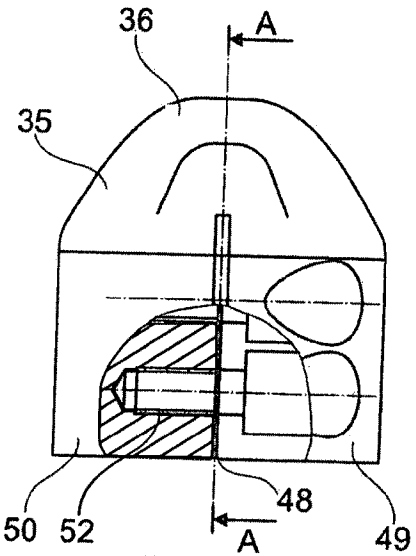
FIG. 15 shows a partial sectional view of the second hinge axle unit according to FIG. 12.
Figure 14:
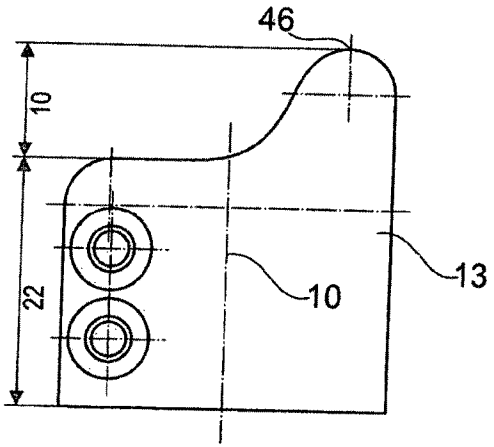
FIG. 14 shows a side view of the second hinge axle unit, the latter as compared to the illustration in FIG. 13 being tilted into the image plane by 90°.

FIGS. 12 to 16 will now be discussed in more detail hereinbelow. FIG. 12 shows a schematic illustration of the second hinge axle unit 13. FIG. 13 shows a plan view of the second hinge axle unit 13 according to FIG. 12. Furthermore, FIG. 14 shows a side view of the second hinge axle unit 13 which as compared to the illustration in FIG. 13 is tilted into the image plane by 90°. FIG. 15 shows a partially sectioned view of the second hinge axle unit 13 according to FIG. 12. Furthermore, FIG. 16 shows a further partially sectioned view of the second hinge axle unit 13 along the line A-A of FIG. 15. The same reference signs indicate the same components.

As is shown particularly in FIG. 12, the second hinge axle unit 13 centrically has a second opening 34 in which the hinge axle pin 9 is disposed. The second hinge axle unit 13 furthermore has a second running face 35. The second running face 35 has a plurality of portions which are illustrated in FIGS. 12 and 13. The second running face 35 thus has a second run-up portion 36, a second gradient portion 37, and a second run-off portion 38. The second gradient portion 37 is disposed between the second run-up portion 36 and the second run-off portion 38, and has a gradient. This will be discussed in yet more detail further below. The external diameter of the second hinge axle unit 13 is, for example, 29 mm, and the height of the second hinge axle unit 3 (measured along the rotation axis 10) is, for example, 20 mm to 35 mm. The diameter of the second opening 34 is, for example, 12 mm.

As is shown particularly in FIG. 13, the second running face 35 extends across 180° across a second divided circular ring 39 in the form of a half ring. The second divided circular ring 39 has a first divided circle 40 in the form of a semicircle, and a second divided circle 41 in the form of a semicircle. The first divided circle 40 of the second divided circular ring 39 from a second center M2 has a first radius $R_{21}$. The second center M2 lies on the rotation axis 10 which runs perpendicularly into the image plane and is disposed so as to be centric in the second opening 34. The second divided circle 41 of the second divided circular ring 39 from the second center M2 has a second radius $R_{22}$. The first radius $R_{21}$ of the first divided circle 40 of the second divided circular ring 39 is larger than the second radius $R_{22}$ of the second divided circle 41 of the second divided circular ring 39. A second divided circular line 42 of the second divided circular ring 39 is disposed between the first divided circle 40 of the second divided circular ring 39 and the second divided circle 41 of the second divided circular ring 39. The second divided circular line 42 of the second divided circular ring 39 from the second center M2 has a third radius $R_{23}$. The third radius $R_{23}$ of the second divided circular line 42 is defined by $$R_{23}=R_{22}+((R_{21}-R_{22})/2)$$

As has already been mentioned above, the second running face 35 extends across 180° across the second divided circular ring 39 in the form of a half ring. The second running face 35 thus also extends across 180° across a second circular arc 43. The second run-up portion 36, the second gradient portion 37, and the second run-off portion 38 are disposed across 180° along the second circular arc 43. For example, the second run-up portion 36 herein runs across 40° along the second circular arc 43. For example, the second gradient portion 37 furthermore runs across 80° along the second circular arc 43. For example, the second run-off portion 38 furthermore runs across 60° along the second circular arc 43. The invention is not limited to the aforementioned angular distances. Rather, any angular distances which are suitable for the invention can be used for the invention.

As has already been mentioned above, the second gradient portion 37 runs across 80° along the second circular arc 43, for example. This is performed, for example, by way of a gradient of 10 mm and of a gradient angle of 34°. In principle, the second gradient portion 37 runs in a helical manner. The invention is not limited to the aforementioned gradient and the aforementioned gradient angle. Rather, any gradients and gradient angles which are suitable for the invention can be used for the invention. For example, the gradient can be in the range from 5 mm to 20 mm, wherein the range limits are included herein. Furthermore, the gradient angle can be in the range from 25° to 45°, wherein the range limits are included herein.

As can be seen particularly from FIG. 12, the second hinge axle unit 13 can have a further second running face 35A which is configured so as to be mirror-symmetrical to the second running face 35, wherein the rotation axis 10 lies in a symmetry plane, this symmetry plane in FIG. 13 running perpendicularly into the image plane.

FIG. 16 shows particularly a further second run-off portion 38A of the further second running face 35A, and the second run-up portion 36 of the second running face 35. The second run-up portion 36 in a side view is configured as a second running face circular arc 44, wherein the second running face circular arc 44, proceeding from a second circular arc center 45, has a second circular arc radius. In the case of the exemplary embodiment illustrated here the second circular arc radius is, for example, 4 mm.

The same applies in analogous manner in terms of the further second run-off portion 38A. Said second run-of portion 38A in a side view is also configured as a further second running face circular arc 44A, wherein the further second running face circular arc 44A, proceeding from a further second circular arc center 45A, has a further second circular arc radius. In the case of the exemplary embodiment illustrated here the further second circular arc radius is, for example, 4 mm.

The entire second running face 35, or at least a substantial part of the second running face 35, is configured like the second run-up portion 36. Particularly, the second gradient portion 37 and the second run-off portion 38 are likewise configured as the second run-up portion 36 and thus have the second running face circular arc 44, wherein the second running face circular arc 44, proceeding from the second circular arc center 44, has the second circular arc radius. The same applies in analogous manner to the further second running face 35A.

As can be seen particularly from FIG. 12, the second run-up portion 36 and the second run-off portion 38 are disposed so as to be spaced apart along the rotation axis 10. As has been explained above, the second gradient portion 37 is disposed between the second run-up portion 36 and the second run-off portion 38, said second gradient portion 37 providing the gradient from the second run-up portion 36 to the second run-off portion 38.

As is shown particularly in FIG. 16, the entire second running face 35, in a side view which is perpendicular to the plan view according to FIG. 13 (for example a sectional view), has second vertexes 46 along the second divided circular line 42 of the second divided circular ring 39, which vertexes are configured as maxima of the second running face 35, and from which second side walls 47 extend downward. In other words, the second side walls 47 extend counter to the movement direction of the first band part 3. In yet again other words, the second running face 35 is configured so as to be completely or substantially concave. This likewise applies to the further second running face 35A.

As has already been mentioned above, the second hinge axle unit 13 has the clamping installation 18 for releasably disposing the second hinge axle unit 13 on the hinge axle pin 9. To this end, the second hinge axle unit 13 is configured so as to be slotted. The second hinge axle unit 13 particularly has a first slot unit 49 and a second slot unit 50, the latter two being separated by a slot 48. Screw elements 51 engage from the first slot unit 49 in threads 52 of the second slot unit 50. The second hinge axle unit 13 can thus be fastened to the hinge axle pin 9. In particular, it is possible for a "zero position", that is a specific relative position of the first band part 3 in relation to the second band part 4, to be set. The specific relative position is, for example, a closing position of the partition element 2.

The features of the invention that have been disclosed in the present description, in the drawings, and in the claims can be relevant individually as well as in arbitrary combinations in order for the invention to be realized in the various embodiments of the latter. The invention is not limited to the embodiments described. The invention may be varied within the scope of the claims and taking into consideration the knowledge of the competent person skilled in the art.

LIST OF REFERENCE SIGNS

1 Hinge band
2 Partition element
3 First band part
4 Second band part
5 Fastening means
6 Receptacle installation
7 First clamping unit
8 Second clamping unit
9 Hinge axle pin
10 Rotation axis
11 Lifting/lowering installation
12 First hinge axle unit
13 Second hinge axle unit
14 External face of the first hinge axle unit
15 Guiding protrusions
16 Guiding receptacles
17 Support face
18 Clamping installation
19 First opening
20 First running face
20A Further first running face
21 First run-up portion
22 First gradient portion
22A Further first gradient portion
23 First run-off portion
24 Latching clearance
25 First divided circular ring
26 First divided circle of the first divided circular ring
27 Second divided circle of the first divided circular ring
28 First divided circular line
29 First circular arc
30 First running face circular arc
30A Further first running face circular arc
31 First circular arc center
31A Further first circular arc center
32 First vertexes (minima)
33 First side wall
34 Second opening
35 Second running face
35A Further second running face
36 Second run-up portion
37 Second gradient portion
38 Second run-off portion
38A Further second run-off portion
39 Second divided circular ring
40 First divided circle of the second divided circular ring
41 Second divided circle of the second divided circular ring
42 Second divided circular line
43 Second circular arc
44 Second running face circular arc
44A Further second running face circular arc
45 Second circular arc center
45A Further second circular arc center
46 Second vertexes (maxima)
47 Second side walls
48 Slot
49 First slot unit
50 Second slot unit
51 Screw elements
52 Threads
M1 First center M2 Second center $R_{11}$ First radius of the first divided circle of the first divided circular ring $R_{12}$ Second radius of the second divided circle of the first divided circular ring $R_{13}$ Third radius of the first divided circular line $R_{21}$ First radius of the first divided circle of the second divided circular ring $R_{22}$ Second radius of the second divided circle of the second divided circular ring $R_{23}$ Third radius of the second divided circular line

The invention claimed is:

1. A hinge band (1) for a partition element (2), having at least one first band part (3);

at least one second band part (4), wherein the first band part (3) is connected to the second band part (4) for hinge action about a hinge axle pin (9) in such a manner that the first band part (3) is rotatable relative to the second band part (4) about a rotation axis (10);

a lifting or lowering installation (11) which is disposed on the first band part (3) and on the second band part (4), wherein on account of the lifting or lowering installation (11) the first band part (3) in a movement of the first band part (3) relative to the second band part (4) about the rotation axis (10) is moved along the rotation axis (10);

at least one receptacle installation (6) for disposing the partition element (2) on the hinge band (1), wherein the lifting or lowering installation (11) has a first hinge axle unit (12) which is disposed on the first band part (3) and which has a first opening (19), wherein the hinge axle pin (9) is disposed in the first opening (19);

the lifting or lowering installation (11) has a second hinge axle unit (13) which is disposed on the second band part (13) and which has a second opening (34), wherein the hinge axle pin (9) is disposed in the second opening (34);

the first hinge axle unit (12) has a first running face (20), wherein the first running face (20) is configured so as to be concave;

the second hinge axle unit (13) has a second running face (35), wherein the second running face (35) is configured so as to be convex;

the first running face (20) is disposed on the second running face (35), and wherein the first running face (20) is configured so as to be movable relative to the second running face (35);

wherein the second running face (35) in a plan view is configured as a second divided circular ring (39);

the second divided circular ring (39) has a first divided circle (40) and a second divided circle (41);

the first divided circle (40) of the second divided circular ring (39) from a second center (M2) has a first radius $R_{21}$;

the second divided circle (41) of the second divided circular ring (39) from the second center (M2) has a second radius $R_{22}$;

the first radius $R_{21}$ of the first divided circle (40) of the second divided circular ring (39) is larger than the second radius $R_{22}$ of the second divided circle (41) of the second divided circular ring (39);

a second divided circular line (42) of the second divided circular ring (39) is disposed between the first divided circle (40) of the second divided circular ring (39) and the second divided circle (41) of the second divided circular ring (39);

the second divided circular line (42) of the second divided circular ring (39) from the second center (M2) has a third radius $R_{23}$, wherein the third radius $R_{23}$ of the second divided circular line (42) is defined by $R_{23}=R_{22}+((R_{21}-R_{22})/2)$, and wherein the second running face (35), in a side view which is perpendicular to the plan view, has second vertexes (46) along the second divided circular line (42) of the second divided circular ring (39), which second vertexes are configured as maxima of the second running face (35) and from which second side walls (47) of the second running face (35) extend downward.

2. The hinge band (1) as claimed in claim 1, wherein the second center (M2) is disposed on the rotation axis (10).

3. The hinge band (1) as claimed in claim 1, wherein the first running face (20) in a side view is configured as a first running face circular arc (30), wherein the first running face circular arc (30), proceeding from a first circular arc center (31), has a first circular arc radius.

4. The hinge band (1) as claimed in claim 1, wherein the second running face (35) in a side view is configured as a second running face circular arc (44), wherein the second running face circular arc (44), proceeding from a second circular arc center (45), has a second circular arc radius.

5. The hinge band (1) as claimed in claim 1, wherein the first running face (20) has a first run-up portion (21), a first gradient portion (22), and a first run-off portion (23);

the first gradient portion (22) is disposed between the first run-up portion (21) and the first run-off portion (23) and has a gradient, and wherein the first run-up portion (21) and the first run-off portion (23) are disposed so as to be mutually spaced apart along the rotation axis (10).

6. The hinge band (1) as claimed in claim 1, wherein the second running face (35) has a second run-up portion (36), a second gradient portion (37), and a second run-off portion (38);

the second gradient portion (37) is disposed between the second run-up portion (36) and the second run-off portion (38) and has a gradient; and wherein the second run-up portion (36) and the second run-off portion (38) are disposed so as to be mutually spaced apart along the rotation axis (10).

7. The hinge band (1) as claimed in claim 1, wherein the hinge band (1) has at least one of the following features:

(i) the second hinge axle unit (13) has a clamping installation (18) for releasably disposing the second hinge axle unit (13) on the hinge axle pin (9);

(ii) the second hinge axle unit (13) is configured so as to be slotted.

8. The hinge band (1) as claimed in claim 1, wherein the hinge band (1) has at least one of the following features:

(i) the receptacle installation (6) is disposed on the first band part (3);

(ii) the receptacle installation (6) has a first clamping unit (7) and a second clamping unit (8) for disposing the partition element (2) in a clamped manner between the first clamping unit (6) and the second clamping unit (7).

9. The hinge band (1) as claimed in claim 1, wherein the hinge band (1) is configured for a door (2) or a window (2).

10. The hinge band (1) as claimed in claim 1, wherein the hinge band (1) has at least one of the following features:

(i) the first running face (20) is configured so as to be partially or completely concave;

(ii) the second running face (35) is configured so as to be partially or completely convex;

(iii) the first opening (19) of the first hinge axle unit (12) is configured as a passage opening;

(iv) the second opening (34) of the second hinge axis unit (13) is configured as a passage opening;

(v) the first opening (19) is disposed so as to be centric on the first hinge axle unit (12);

(vi) the second opening (34) is disposed so as to be centric on the second hinge axle unit (13).

11. The hinge band (1) as claimed in claim 1, further comprising a latch disposed on the first hinge axle unit (12) and on the second hinge axle unit (13).

12. A partition installation having at least one partition element (2) and at least one hinge band (1) as claimed in claim 1.

13. The partition installation as claimed in claim 12, wherein the partition element (2) is configured as a door or as a window.

14. A hinge band (1) for a partition element (2), having at least one first band part (3);

at least one second band part (4), wherein the first band part (3) is connected to the second band part (4) for hinge action about a hinge axle pin (9) in such a manner that the first band part (3) is rotatable relative to the second band part (4) about a rotation axis (10);

a lifting or lowering installation (11) which is disposed on the first band part (3) and on the second band part (4), wherein on account of the lifting or lowering installation (11) the first band part (3) in a movement of the first band part (3) relative to the second band part (4) about the rotation axis (10) is moved along the rotation axis (10);

at least one receptacle installation (6) for disposing the partition element (2) on the hinge band (1), wherein the lifting or lowering installation (11) has a first hinge axle unit (12) which is disposed on the first band part (3) and which has a first opening (19), wherein the hinge axle pin (9) is disposed in the first opening (19);

the lifting or lowering installation (11) has a second hinge axle unit (13) which is disposed on the second band part (13) and which has a second opening (34), wherein the hinge axle pin (9) is disposed in the second opening (34);

the first hinge axle unit (12) has a first running face (20), wherein the first running face (20) is configured so as to be concave;

the second hinge axle unit (13) has a second running face (35), wherein the second running face (35) is configured so as to be convex;

the first running face (20) is disposed on the second running face (35), and wherein the first running face (20) is configured so as to be movable relative to the second running face (35);

wherein;

the first running face (20) has a first run-up portion (21), a first gradient portion (22), and a first run-off portion (23);

the first gradient portion (22) is disposed between the first run-up portion (21) and the first run-off portion (23) and has a gradient, and wherein the first run-up portion (21) and the first run-off portion (23) are disposed so as to be mutually spaced apart along the rotation axis (10);

and wherein;

the first run-up portion (21), the first gradient portion (22), and the first run-off portion (23) are disposed across 180° along a first circular arc (29);

the first run-up portion (21) is disposed across 40° along the first circular arc (29);

the first gradient portion (22), having a gradient of 10 mm and a gradient angle of 34°, is disposed across 80° along the first circular arc (29); and wherein the first run-off portion (23) is disposed across 60° along the first circular arc (29).

15. The hinge band (1) as claimed in claim 14, wherein the hinge band (1) has at least one of the following features:

(i) the second hinge axle unit (13) has a clamping installation (18) for releasably disposing the second hinge axle unit (13) on the hinge axle pin (9);

(ii) the second hinge axle unit (13) is configured so as to be slotted;

(iii) the receptacle installation (6) is disposed on the first band part (3);

(iv) the receptacle installation (6) has a first clamping unit (7) and a second clamping unit (8) for disposing the partition element (2) in a clamped manner between the first clamping unit (6) and the second clamping unit (7);

(v) the first running face (20) is configured so as to be partially or completely concave;

(vi) the second running face (35) is configured so as to be partially or completely convex;

(vii) the first opening (19) of the first hinge axle unit (12) is configured as a passage opening;

(viii) the second opening (34) of the second hinge axis unit (13) is configured as a passage opening;

(ix) the first opening (19) is disposed so as to be centric on the first hinge axle unit (12);

(x) the second opening (34) is disposed so as to be centric on the second hinge axle unit (13).

16. A hinge band (1) for a partition element (2), having at least one first band part (3);

at least one second band part (4), wherein the first band part (3) is connected to the second band part (4) for hinge action about a hinge axle pin (9) in such a manner that the first band part (3) is rotatable relative to the second band part (4) about a rotation axis (10);

a lifting or lowering installation (11) which is disposed on the first band part (3) and on the second band part (4), wherein on account of the lifting or lowering installation (11) the first band part (3) in a movement of the first band part (3) relative to the second band part (4) about the rotation axis (10) is moved along the rotation axis (10);

at least one receptacle installation (6) for disposing the partition element (2) on the hinge band (1), wherein the lifting or lowering installation (11) has a first hinge axle unit (12) which is disposed on the first band part (3) and which has a first opening (19), wherein the hinge axle pin (9) is disposed in the first opening (19);

the lifting or lowering installation (11) has a second hinge axle unit (13) which is disposed on the second band part (13) and which has a second opening (34), wherein the hinge axle pin (9) is disposed in the second opening (34);

the first hinge axle unit (12) has a first running face (20), wherein the first running face (20) is configured so as to be concave;

the second hinge axle unit (13) has a second running face (35), wherein the second running face (35) is configured so as to be convex;

the first running face (20) is disposed on the second running face (35), and wherein the first running face (20) is configured so as to be movable relative to the second running face (35);

and wherein;

the second running face (35) has a second run-up portion (36), a second gradient portion (37), and a second run-off portion (38);

the second gradient portion (37) is disposed between the second run-up portion (36) and the second run-off portion (38) and has a gradient; and wherein the second run-up portion (36) and the second run-off portion (38) are disposed so as to be mutually spaced apart along the rotation axis (10);

and wherein;

the second run-up portion (36), the second gradient portion (37), and the second run-off portion (38) are disposed across 180° along a second circular arc (43);

the second run-up portion (36) is disposed across 40° along the second circular arc (43);

the second gradient portion (37), having a gradient of 10 mm and a gradient angle of 34°, is disposed across 80° along the second circular arc (43); and wherein the second run-off portion (38) is disposed across 60° along the second circular arc (29).

17. A hinge band (1) for a partition element (2), having at least one first band part (3);

at least one second band part (4), wherein the first band part (3) is connected to the second band part (4) for hinge action about a hinge axle pin (9) in such a manner that the first band part (3) is rotatable relative to the second band part (4) about a rotation axis (10);

a lifting or lowering installation (11) which is disposed on the first band part (3) and on the second band part (4), wherein on account of the lifting or lowering installation (11) the first band part (3) in a movement of the first band part (3) relative to the second band part (4) about the rotation axis (10) is moved along the rotation axis (10);

at least one receptacle installation (6) for disposing the partition element (2) on the hinge band (1); and wherein the lifting or lowering installation (11) has a first hinge axle unit (12) which is disposed on the first band part (3) and which has a first opening (19), wherein the hinge axle pin (9) is disposed in the first opening (19);

the lifting or lowering installation (11) has a second hinge axle unit (13) which is disposed on the second band part (13) and which has a second opening (34), wherein the hinge axle pin (9) is disposed in the second opening (34);

the first hinge axle unit (12) has a first running face (20), wherein the first running face (20) is configured so as to be concave;

the second hinge axle unit (13) has a second running face (35), wherein the second running face (35) is configured so as to be convex;

the first running face (20) is disposed on the second running face (35), and wherein the first running face (20) is configured so as to be movable relative to the second running face (35); and wherein the first running face (20) in a plan view is configured as a first divided circular ring (25);

the first divided circular ring (25) has a first divided circle (26) and a second divided circle (27);

the first divided circle (26) of the first divided circular ring (25) from a first center (M1) has a first radius $R_{11}$;

the second divided circle (27) of the first divided circular ring (25) from the first center (M1) has a second radius $R_{12}$;

the first radius $R_{11}$ of the first divided circle (26) of the first divided circular ring (25) is larger than the second radius $R_{12}$ of the second divided circle (27) of the first divided circular ring (25);

a first divided circular line (28) of the first divided circular ring (25) is disposed between the first divided circle (26) of the first divided circular ring (25) and the second divided circle (27) of the first divided circular ring (25);

the first divided circular line (28) of the first divided circular ring (25) from the first center (M1) has a third radius $R_{13}$, wherein the third radius $R_{13}$ of the first divided circular line (28) is defined by $R_{13}=R_{12}+((R_{11}-R_{12})/2)$; and wherein the first running face (20), in a side view which is perpendicular to the plan view, along the first divided circular line (28) of the first divided circular ring (25) has first vertexes (32) which are configured as minima of the first running face (20) and from which first side walls (33) of the first running face (20) extend downward.

18. The hinge band (1) as claimed in claim 17, wherein the first center (M1) is disposed on the rotation axis (10).

19. The hinge band (1) as claimed in claim 17, wherein the second running face (35) in the plan view is configured as a second divided circular ring (39);

the second divided circular ring (39) has a first divided circle (40) and a second divided circle (41);

the first divided circle (40) of the second divided circular ring (39) from a second center (M2) has a first radius $R_{21}$;

the second divided circle (41) of the second divided circular ring (39) from the second center (M2) has a second radius $R_{22}$;

the first radius $R_{21}$ of the first divided circle (40) of the second divided circular ring (39) is larger than the second radius $R_{22}$ of the second divided circle (41) of the second divided circular ring (39);

a second divided circular line (42) of the second divided circular ring (39) is disposed between the first divided circle (40) of the second divided circular ring (39) and the second divided circle (41) of the second divided circular ring (39);

the second divided circular line (42) of the second divided circular ring (39) from the second center (M2) has a third radius $R_{23}$, wherein the third radius $R_{23}$ of the second divided circular line (42) is defined by $R_{23}=R_{22}+((R_{21}-R_{22})/2)$; and wherein the second running face (35), in a side view which is perpendicular to the plan view, has second vertexes (46) along the second divided circular line (42) of the second divided circular ring (39), which second vertexes are configured as maxima of the second running face (35) and from which second side walls (47) of the second running face (35) extend downward.

20. The hinge band (1) as claimed in claim 19, wherein the second center (M2) is disposed on the rotation axis (10).

21. The hinge band (1) as claimed in claim 17, wherein the first running face (20) in a side view is configured as a first running face circular arc (30), wherein the first running face circular arc (30), proceeding from a first circular arc center (31), has a first circular arc radius.

22. The hinge band (1) as claimed in claim 17, wherein the second running face (35) in a side view is configured as a second running face circular arc (44), wherein the second running face circular arc (44), proceeding from a second circular arc center (45), has a second circular arc radius.

23. The hinge band (1) as claimed in claim 17, wherein the first running face (20) has a first run-up portion (21), a first gradient portion (22), and a first run-off portion (23);

the first gradient portion (22) is disposed between the first run-up portion (21) and the first run-off portion (23) and has a gradient, and wherein the first run-up portion (21) and the first run-off portion (23) are disposed so as to be mutually spaced apart along the rotation axis (10).

24. The hinge band (1) as claimed in claim 23, wherein the first run-up portion (21), the first gradient portion (22), and the first run-off portion (23) are disposed across 180° along a first circular arc (29);

the first run-up portion (21) is disposed across 40° along the first circular arc (29);

the first gradient portion (22), having a gradient of 10 mm and a gradient angle of 34°, is disposed across 80° along the first circular arc (29); and wherein the first run-off portion (23) is disposed across 60° along the first circular arc (29).

25. The hinge band (1) as claimed in claim 17, wherein the second running face (35) has a second run-up portion (36), a second gradient portion (37), and a second run-off portion (38);

the second gradient portion (37) is disposed between the second run-up portion (36) and the second run-off portion (38) and has a gradient; and wherein the second run-up portion (36) and the second run-off portion (38) are disposed so as to be mutually spaced apart along the rotation axis (10).

26. The hinge band (1) as claimed in claim 25, wherein the second run-up portion (36), the second gradient portion (37), and the second run-off portion (38) are disposed across 180° along a second circular arc (43);

the second run-up portion (36) is disposed across 40° along the second circular arc (43);

the second gradient portion (37), having a gradient of 10 mm and a gradient angle of 34°, is disposed across 80° along the second circular arc (43); and wherein the second run-off portion (38) is disposed across 60° along the second circular arc (29).

27. The hinge band (1) as claimed in claim 17, wherein the hinge band (1) has at least one of the following features:

(i) the second hinge axle unit (13) has a clamping installation (18) for releasably disposing the second hinge axle unit (13) on the hinge axle pin (9);

(ii) the second hinge axle unit (13) is configured so as to be slotted.

28. The hinge band (1) as claimed in claim 17, wherein the hinge band (1) has at least one of the following features:

(i) the receptacle installation (6) is disposed on the first band part (3);

(ii) the receptacle installation (6) has a first clamping unit (7) and a second clamping unit (8) for disposing the partition element (2) in a clamped manner between the first clamping unit (6) and the second clamping unit (7).

29. The hinge band (1) as claimed in claim 17, wherein the hinge band (1) is configured for a door (2) or a window (2).

30. The hinge band (1) as claimed in claim 17, wherein the hinge band (1) has at least one of the following features:

(i) the first running face (20) is configured so as to be partially or completely concave;

(ii) the second running face (35) is configured so as to be partially or completely convex;

(iii) the first opening (19) of the first hinge axle unit (12) is configured as a passage opening;

(iv) the second opening (34) of the second hinge axis unit (13) is configured as a passage opening;

(v) the first opening (19) is disposed so as to be centric on the first hinge axle unit (12);

(vi) the second opening (34) is disposed so as to be centric on the second hinge axle unit (13).

31. The hinge band (1) as claimed in claim 17, further comprising a latch disposed on the first hinge axle unit (12) and on the second hinge axle unit (13).

32. A partition installation having at least one partition element (2) and at least one hinge band (1) as claimed in claim 17.

33. The partition installation as claimed in claim 32, wherein the partition element (2) is configured as a door or as a window.

* * * * *